US005984450A

United States Patent [19]

Becker et al.

[11] Patent Number: 5,984,450

[45] **Date of Patent: *Nov. 16, 1999**

[54] INKJET PRINTER HAVING MULTIPLE PRINTHEADS AND MULTIPLE INDEPENDENT PRINTHEAD SERVICE STATIONS FOR PERFORMING DIFFERENT WIPING PROCEDURES

[75] Inventors: Richard A. Becker, Barcelona, Spain; William S. Osborne, Vancouver, Wash.

[73] Assignee: Hewlett-Packard Company, Palo Alto, Calif.

[ * ] Notice: This patent is subject to a terminal disclaimer.

[21] Appl. No.: 08/399,380

[22] Filed: Mar. 6, 1995

[51] Int. Cl.[6] ..... B41J 2/165

[52] U.S. Cl. ..... 347/24; 347/33

[58] Field of Search ..... 347/24, 33, 28, 347/29, 30, 32

[56] References Cited

U.S. PATENT DOCUMENTS

| | | | |
|---|---|---|---|
| 4,577,203 | 3/1986 | Kawamura | 347/33 |
| 5,103,244 | 4/1992 | Gast et al. | 347/33 |
| 5,151,715 | 9/1992 | Ward et al. | 347/33 |
| 5,155,497 | 10/1992 | Martin et al. | 347/32 |
| 5,182,582 | 1/1993 | Okamura | 347/33 |
| 5,432,539 | 7/1995 | Anderson | 347/33 |
| 5,440,331 | 8/1995 | Grange | 347/33 |
| 5,450,105 | 9/1995 | Dangelo | 347/30 |

FOREIGN PATENT DOCUMENTS

| | | |
|---|---|---|
| 0378387 | 7/1990 | European Pat. Off. . |
| 0410691 | 1/1991 | European Pat. Off. . |
| 0465260 | 1/1992 | European Pat. Off. . |
| 0498579 | 8/1992 | European Pat. Off. . |
| 0585901A2 | 3/1994 | European Pat. Off. . |
| 0673772A1 | 9/1995 | European Pat. Off. . |
| 0674996 | 10/1995 | European Pat. Off. . |
| 58194554 | 11/1983 | Japan . |

*Primary Examiner*—N. Le
*Assistant Examiner*—Thien Tran
*Attorney, Agent, or Firm*—David S. Romney

[57] ABSTRACT

An inkjet printer with multiple printheads in a carriage divides service station functions between a first service station and a second service station. In a preferred embodiment, a black ink printhead is carried by the carriage to a stop position in the first service station where a wiper dedicated to the black ink printhead moves across a stationary nozzle array in a first wiping procedure, and color ink printheads are carried by the carriage to a second service station to move a nozzle array across stationary wipers respectively dedicated to each color ink printhead. The first service station provides spittoon services to all printheads, and the second service station provides capping as well as priming services to all printheads.

24 Claims, 16 Drawing Sheets

| INKJET CARTRIDGES | FIRST SERVICE STATION | | | SECOND SERVICE STATION | | | |
|---|---|---|---|---|---|---|---|
| | SPIT | WIPE | SCRAPE | CAP | PRIME | – | – |
| BLACK PRINTHEAD | SPIT | – | – | CAP | PRIME | WIPE | SCRAPE |
| CYAN PRINTHEAD | SPIT | – | – | CAP | PRIME | WIPE | SCRAPE |
| MAGENTA PRINTHEAD | SPIT | – | – | CAP | PRIME | WIPE | SCRAPE |
| YELLOW PRINTHEAD | SPIT | – | – | CAP | PRIME | WIPE | SCRAPE |

INKJET PRINTER HAVING MULTIPLE PRINTHEADS AND MULTIPLE INDEPENDENT PRINTHEAD SERVICE STATIONS FOR PERFORMING DIFFERENT WIPING PROCEDURES

RELATED APPLICATIONS

This application is related to the following applications, all of which are assigned to the same assignee as the present case and are incorporated herein by reference:

Ser. No. 08/141,261 entitled MIXED RESOLUTION PRINTING FOR COLOR AND MONOCHROME PRINTERS filed in the names of Donald G. Harris et al. on Oct. 29, 1993; which was abandoned.

Ser. No. 08/056,326 entitled MANUAL PEN SELECTION FOR CLEARING NOZZLES WITHOUT REMOVAL FROM PEN CARRIAGE filed in the name of Michael T. Dangelo on Apr. 30, 1993; and patent as U.S. Pat. No. 5,450,105.

Ser. No. 08/225,039 entitled WIPING SYSTEM FOR INKJET PRINTER filed in the names of William H. Schwiebert et al. on Apr. 8, 1994;

Ser. No. 08/224,918 entitled WET-WIPING TECHNIQUE FOR INKJET PRINTHEAD filed in the names of Amy Van Liew et al. on Apr. 8, 1994;

Ser. No. 08/330,461 entitled ORTHOGONAL ROTARY WIPING SYSTEM FOR INKJET PRINTHEADS filed in the names of William S. Osborne, et al. on Oct. 28, 1994; and patented as U.S. Pat. No. 5,614,930.

Ser. No. 08/399,397 entitled CUSTOMIZED PRINTHEAD SERVICING FOR DIFFERENT PRINTER CONDITIONS filed in the names of Paul E. Martinson et al. on Mar. 6, 1995; and patented as U.S. Pat. No. 5,793,388.

Ser. No. 08/398,720 entitled ACTUATION NECHANISM FOR TRANSLATIONAL WIPING OF A STATIONARY INKJET PRINTHEAD filed in the names of David C. Burney, et al on Mar. 6, 1995; and patented as U.S. Pat. No. 5,886,716.

Ser. No. 08/398,709 entitled TRANSLATIONAL WIPING TECHNIQUE FOR A STATIONARY INKJET PRINTHEAD filed in the names of Richard A. Becker, et al. on Mar. 6, 1995; and patented as U.S. Pat. No. 5,898,445.

BACKGROUND OF THE INVENTION

This application relates generally to inkjet printing, and more particularly to online service station functions of spitting ink into a spittoon, wiping ink orifices, capping an array of nozzles on a printhead, and priming inkjet cartridges, Some prior color inkjet pen cartridges functioned somewhat satisfactorily with no wiping and minimal capping. Other prior monochrome/color inkjet cartridges used in single cartridge printers were wiped and capped with relatively simple mechanisms of the type shown in U.S. Pat. No. 4,583,717. Complex problems arose when trying to service different types of printheads on multiple ink cartridges mounted together in a print carrriage, particularly when the ink cartridges have different types of color/black inks.

BRIEF SUMMARY OF THE INVENTION

An inkjet printer with multiple printheads in a carriage provides for certain printhead services to be performed in a first service station and other printhead services to be performed in a second service station. In a preferred embodiment, a high resolution black ink printhead with pigment based ink is carried by the carriage to a stop position in the first service station where a first wiper unit dedicated to the black ink printhead moves across a stationary nozzle array with a first type of wiper blade, and color ink printheads are carried by the carriage to a second service station to move a nozzle array across a second type of stationary wipers which are different from the first type and which are respectively dedicated to each color ink printhead. The first service station provides spittoon services to all printheads, and the second service station provides capping as well as priming services to all printheads. The spittoon is incorporated as part of the wiper unit, and a stationary scraper removes residual ink from the first wiper unit for the black ink printhead for deposit in the spittoon.

The black ink cartridge is on one side of the carriage to be closest to the first service station to minimize the time required to perform wiping and spitting services for the black ink cartridge.

Figure 16A:
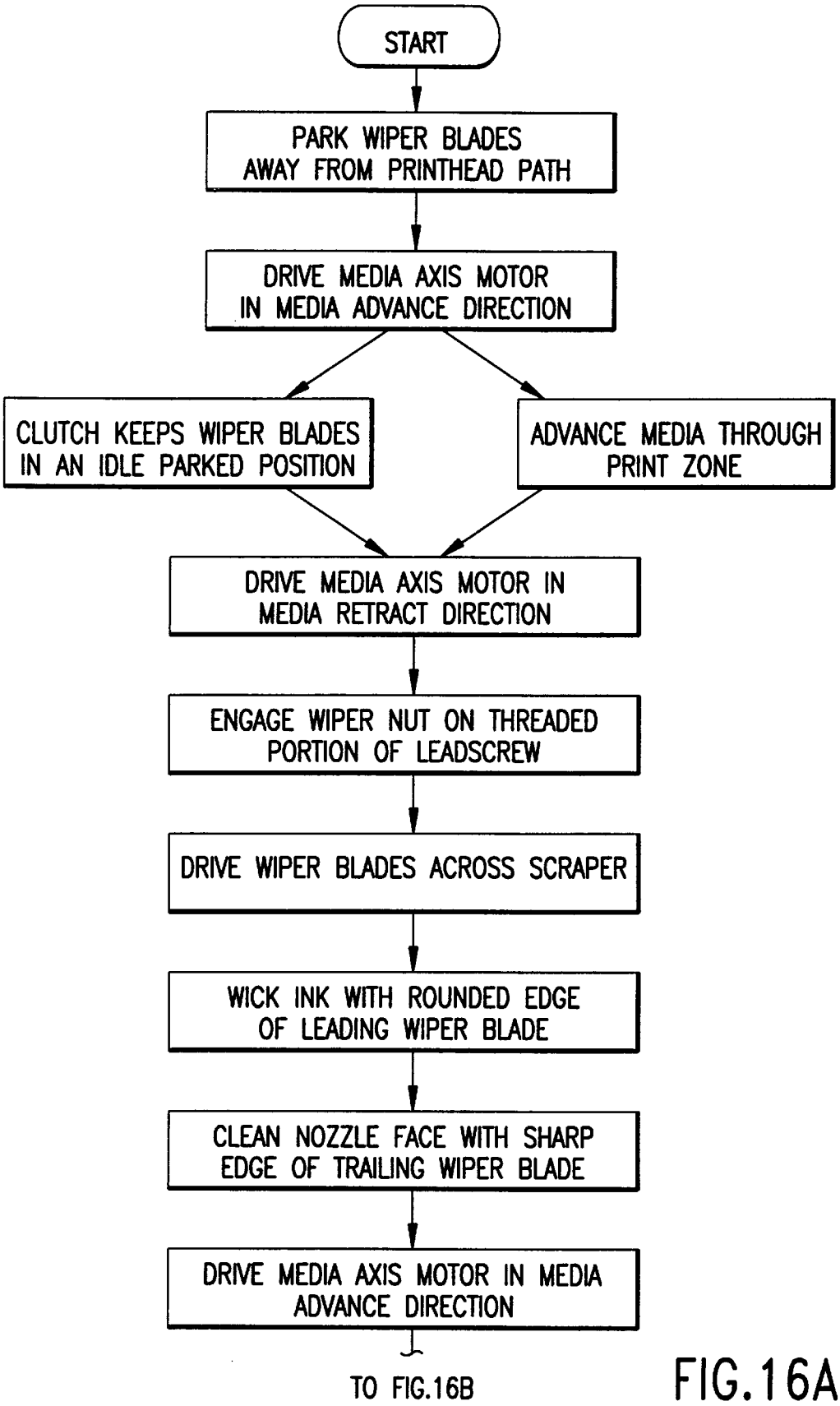
Figure 16B:
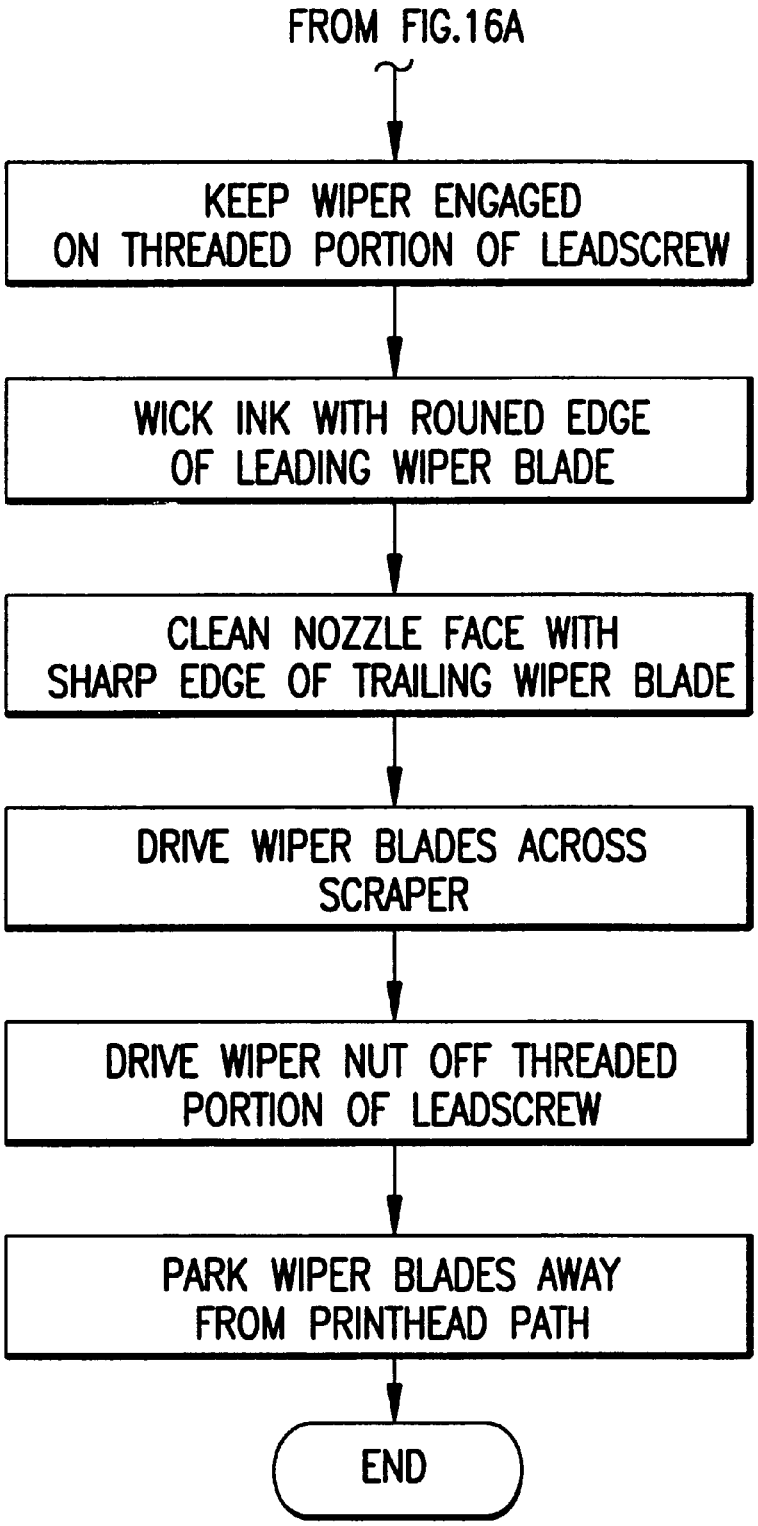
Figure 17:
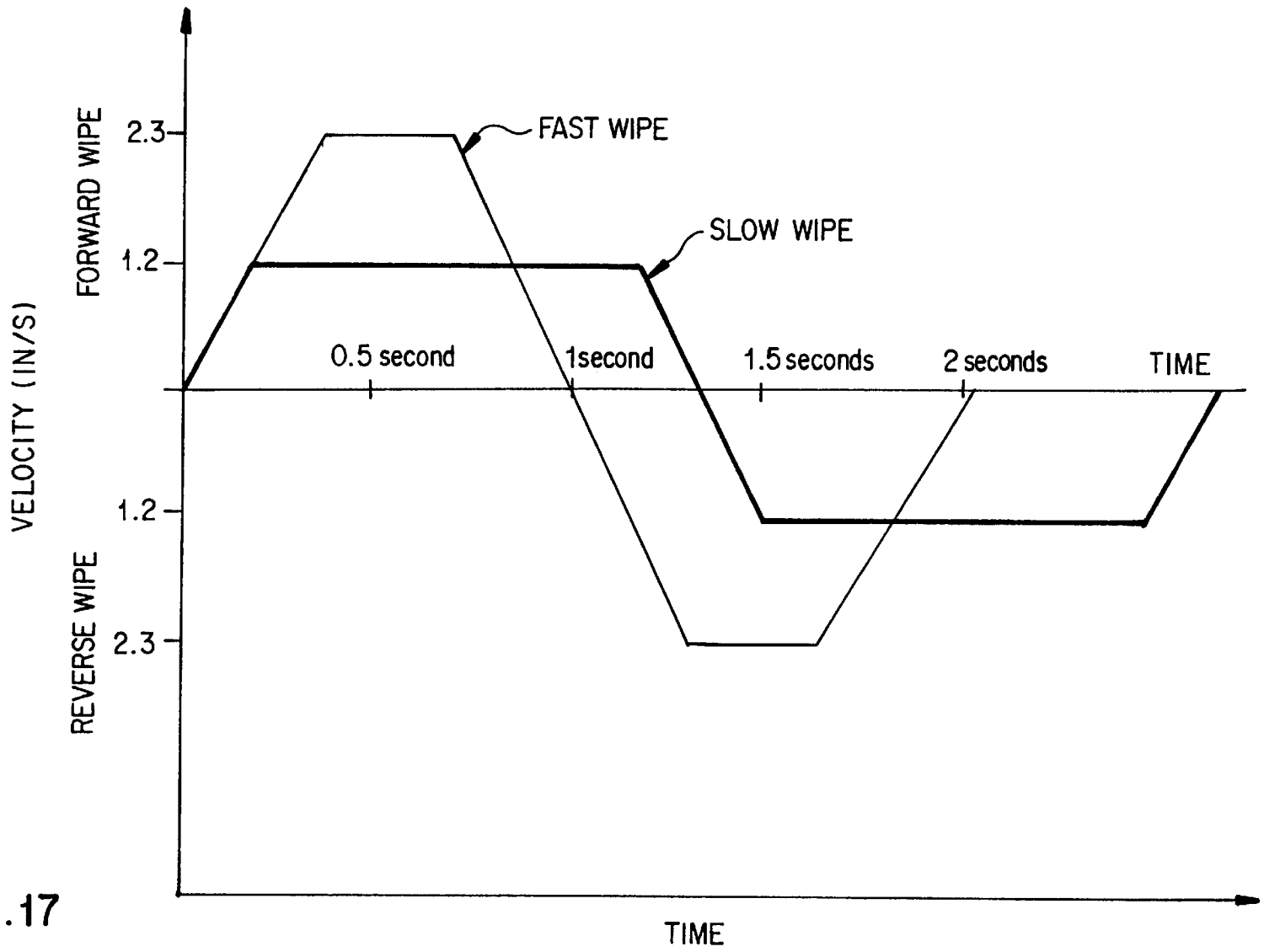

FIGS. 16A and 16B are a flow chart showing the service station methods and techniques of the first service station; and FIG. 17 is a timing diagram for a complete wiping cycle of the first service station.

DETAILED DESCRIPTION OF PREFERRED EMBODIMENTS

In a presently preferred embodiment of the invention disclosed herein, we have combined a 600 dpi ½ inch swath black pen with three 300 dpi color pens each generating a swath of approximately ⅓ inch. The high performance black pen has pigment based ink and is typically used for printing text and other "black only" features, and thus the output quality and throughput of these features is greater. It also improves the output quality of color graphics and color features by teaming with the three lower resolution color pens which have dye based inks for printing color graphics or color features. The black component of the graphics is often a large portion of color graphics content is at a higher resolution and thus at a higher output quality level. The larger swath of the black pen can thus be combined with printing algorithms to improve the throughput of color graphics.

Figure 1:
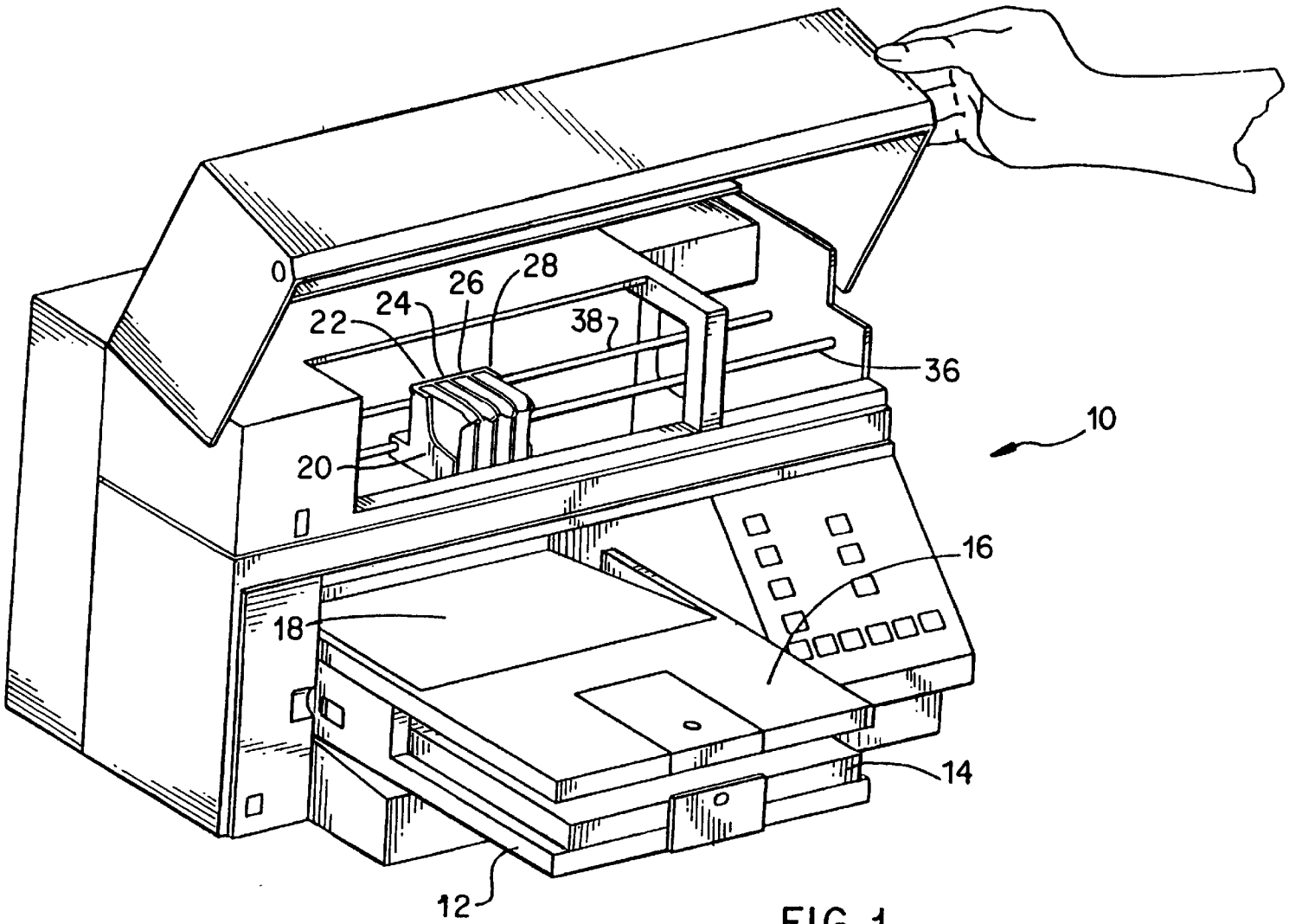
FIG. 1 is a perspective view of a type of inkjet printer which can incorporate the service station features of the present invention.
Figure 2:
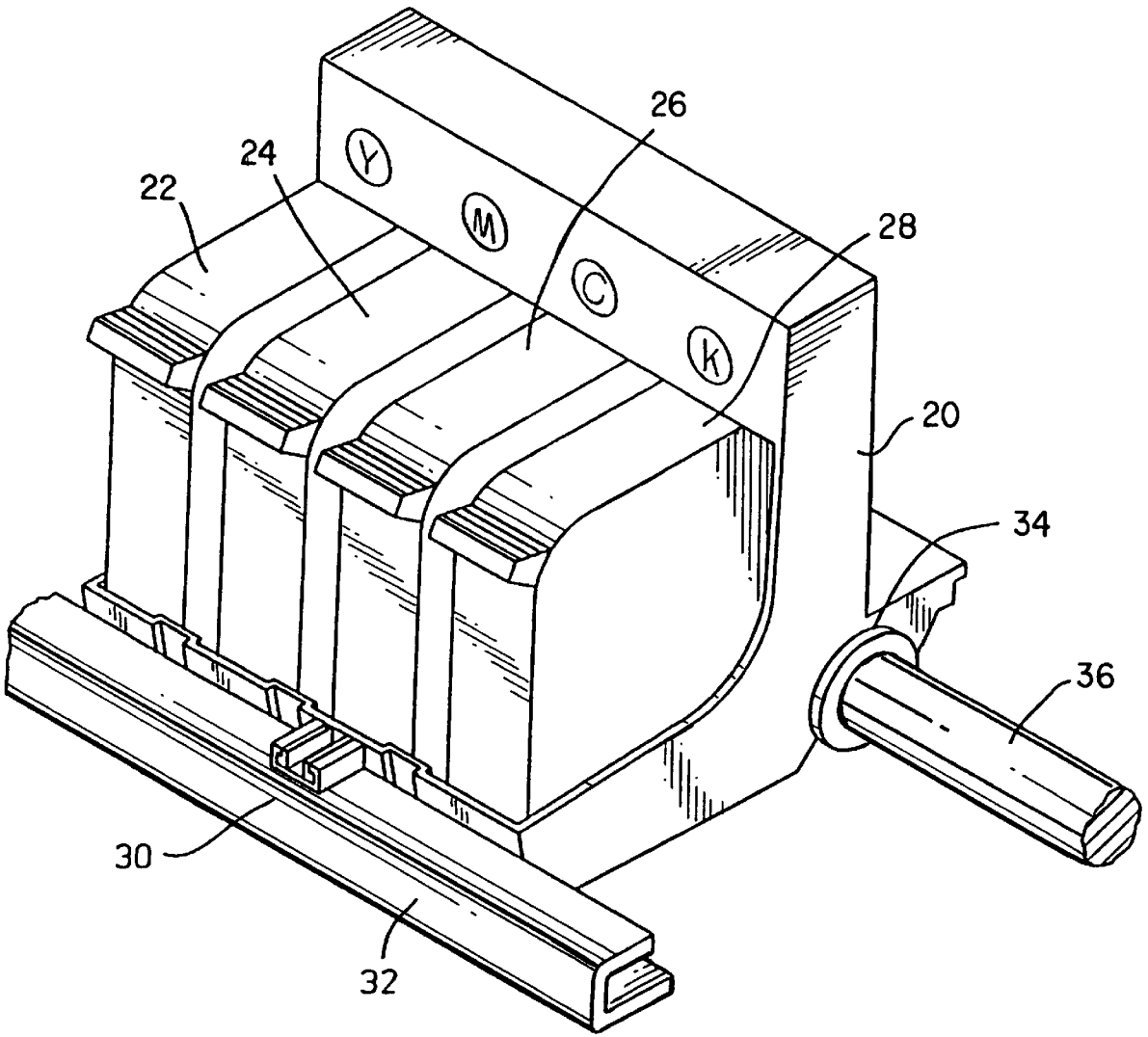
FIG. 2 is a perspective view of the carriage of the inkjet printer of FIG. 1, with yellow (Y), magenta (M), cyan (C) and black (K) inkjet cartridges removably mounted in the carriage.

Even though the invention can be used in any printing environment where text and/or graphics are applied to media using monochrome and/or color components, the presently preferred embodiment of the invention is used in an inkjet printer of the type shown in FIG. 1. In particular, inkjet printer 10 includes an input tray 12 containing sheets of media 14 which pass through a print zone, and are fed past an exit 18 into an output tray 16. Referring to FIGS. 1–2, a movable carriage 20 holds print cartridges 22, 24, 26, and 28 which respectively hold yellow (Y), magenta (M), cyan (C) and black (K) inks. The front of the carriage has a support bumper 30 which rides along a guide 32 while the back of the carriage has multiple bushings such as 34 which ride along slide rod 36. The position of the carriage as it traverses back and forth across the media is determined from an encoder strip 38 in order to be sure that the various ink nozzles on each print cartridge are selectively fired at the appropriate time during a carriage scan.

Of course, the invention is applicable to printers wherein cartridge printheads are completely or partially staggered relative to each other in the direction of the media advance axis in order to provide better throughput, avoid color bleed, etc. or may be in direct alignment to provide overlapping swaths during a single pass of the carriage over a print zone. The invention provides a unique way for selectively servicing only certain individual cartridges during a given time period, or for performing some service activities at one station and other service activities at another, or for performing all services at the same time in the same station, regardless of the staggered or aligned relationship of the printheads, and all without removing the printhead cartridges from a print carriage, as described in more detail below.

Figure 15:
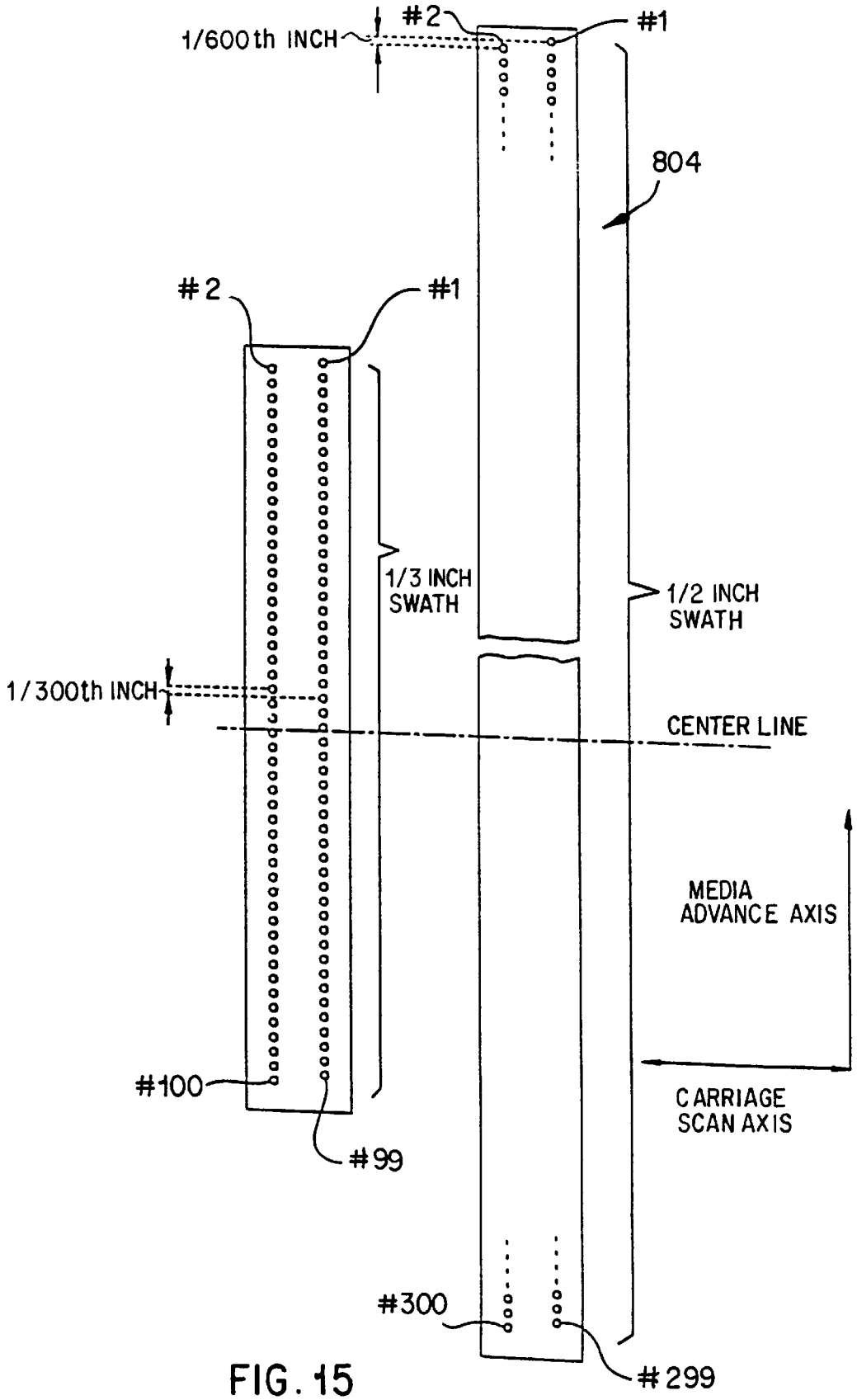
FIG. 15 schematically shows the nozzle arrays for a wide swath 600 dpi black ink printhead and a narrow swath 300 dpi color ink printhead, respectively, which can be serviced by the service station methods and techniques of the present invention.

While not limited to ink printheads have a particular type, size, resolution or configuration, the illustrated embodiment of the invention is used with ink cartridges having a double column of ink orifices which extend in the media advance axis of the printer (see FIG. 15).

In the illustrated embodiment, wiping of the three color printheads is accomplished in a conventional manner by stationary wipers having a narrow blade portion with a top edge for rubbing across the nozzle plate as the print cartridge moves past the wipers. Scraping the stationary wipers is also accomplished in a conventional manner by using a snout edge of the moving printhead. Capping of the three color ink printheads (as well as for the black ink printhead) is accomplished in a conventional manner by a capper having four sets of perimeter lips for completely surrounding the orifice pattern without overlapping any outer edge of the nozzle plate. Priming of the three color ink printheads (as well as for the black ink printhead) is accomplished in a conventional manner by a vacuum primer.

Figure 3:
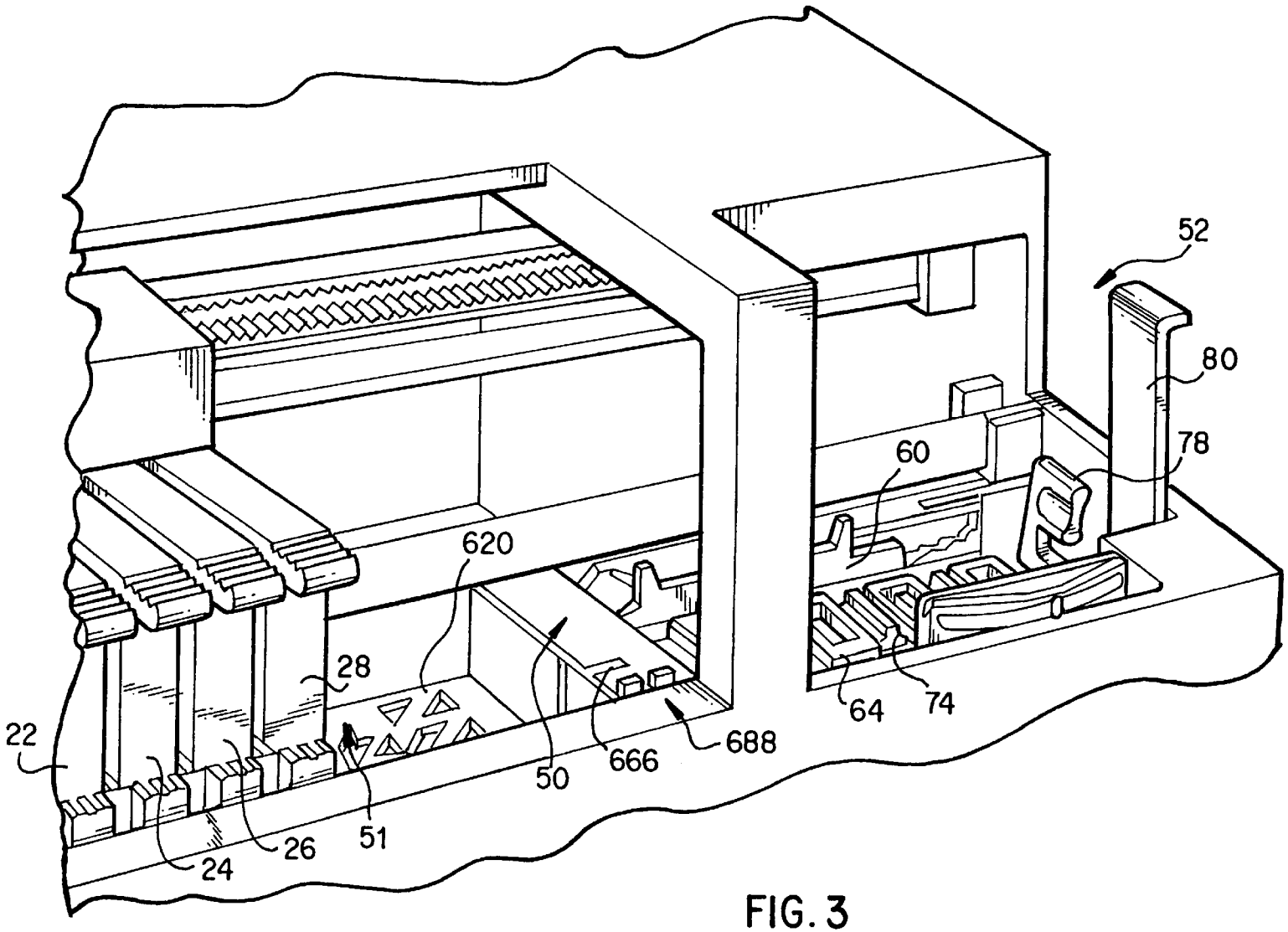
FIG. 3 is a close-up perspective view of a presently preferred embodiment of a service station unit which has been installed in the inkjet printer of FIG. 1.
Figures 4A, 4B:
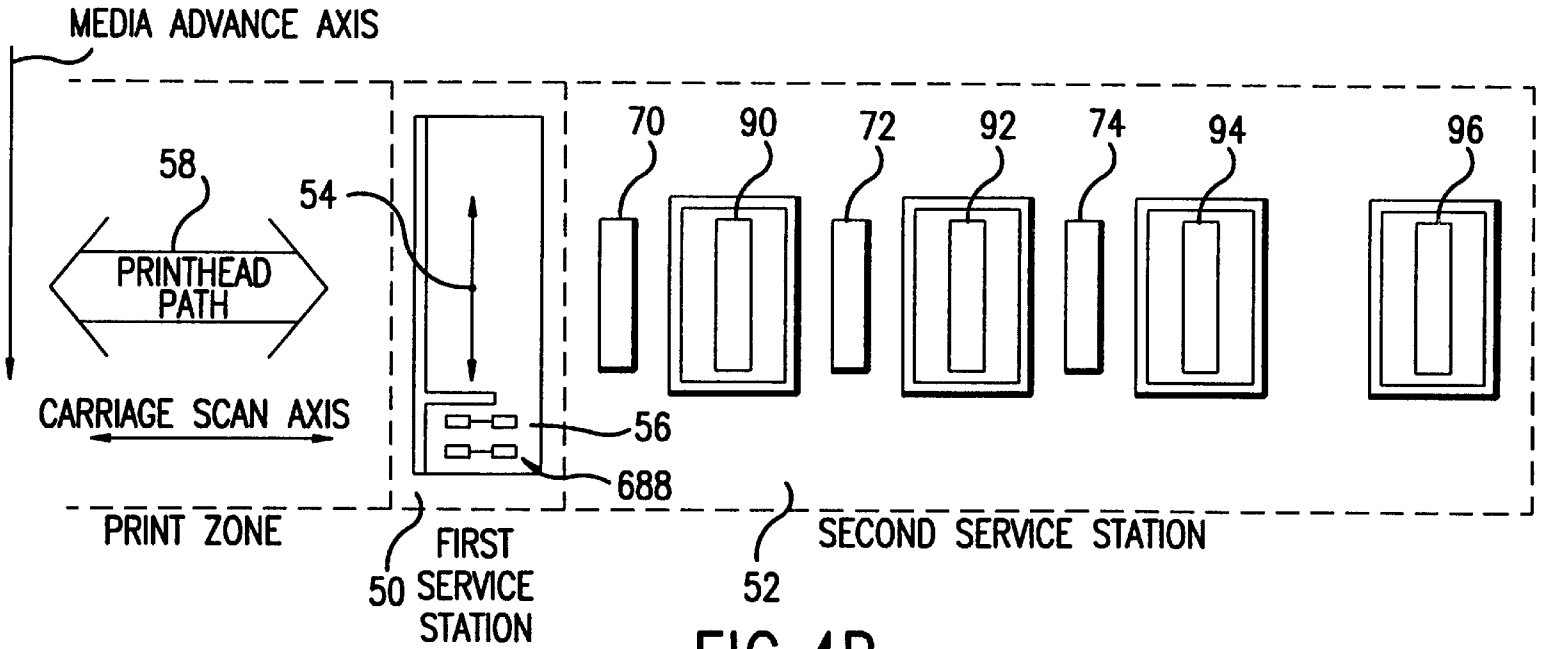
FIGS. 4A and 4B are tabular and schematic representations showing the allocation of printhead services between first and second service stations which are incorporated in the service station unit of FIG. 3.

However, as shown in FIGS. 3 and 4A–4B, the service station functions of the present invention are generally divided between a first service station 50 which is immediately on the right of a print zone 51 and a second service station 52 which is on the right of the first service station. The service functions of each are set forth in tabular form in FIG. 4A, and shown schematically in FIG. 4B. The direction of the translational back-and-forth wiping of the 600 dpi pigment based black ink printhead is identified by arrow 54 which is orthogonal to the carriage scan axis. Moreover, a home location 56 for parking wiper blade member 688 during an actual printing operation is located away from printhead path 58, to avoid interference with any of the printheads which extend into the service station section of the printer at the end of each printing swath.

Figure 5:
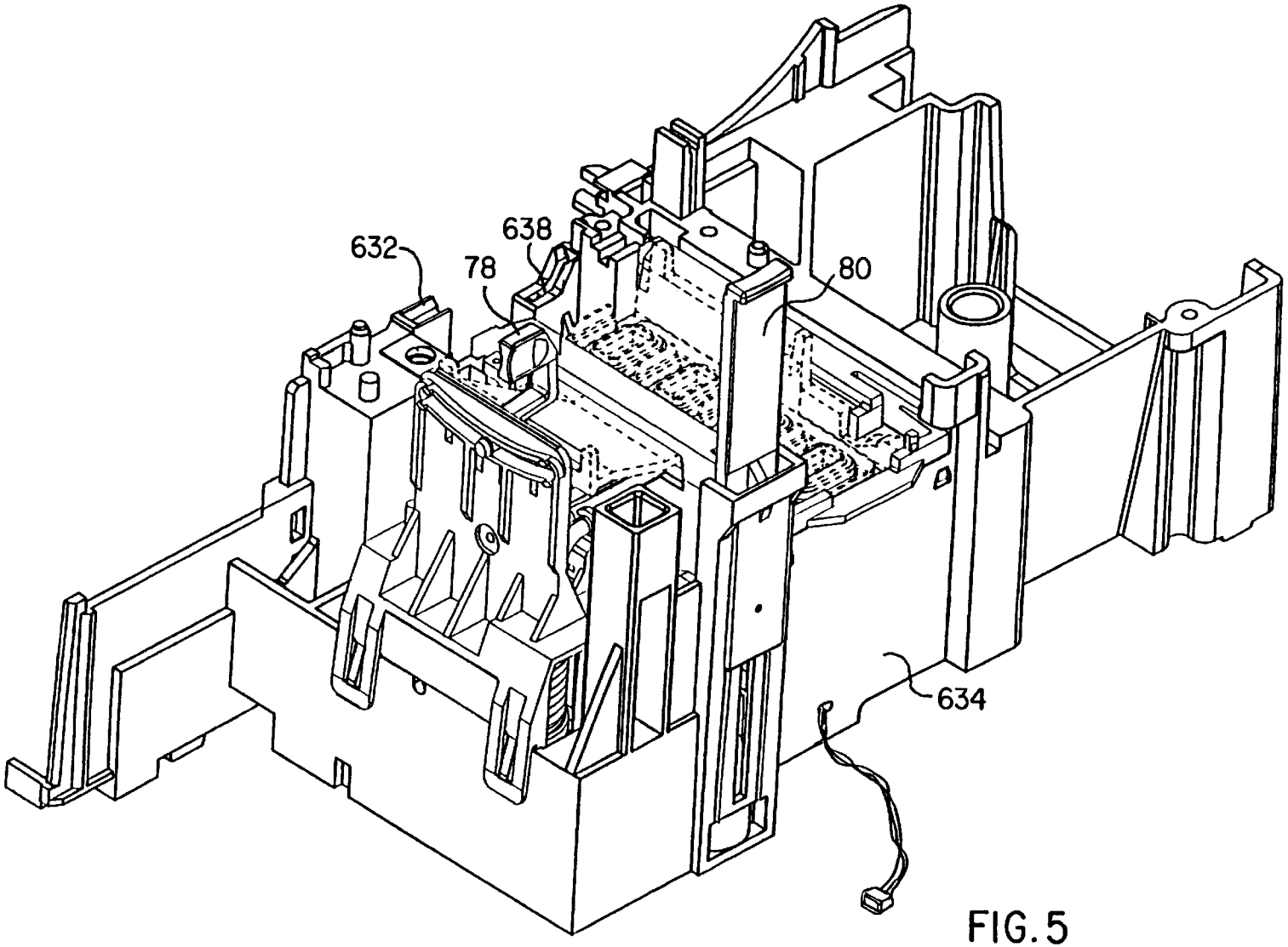
FIG. 5 is a perspective view of a housing portion of the service station unit of FIG. 3, with certain functional components of the second service station shown in dotted lines.
Figure 6:
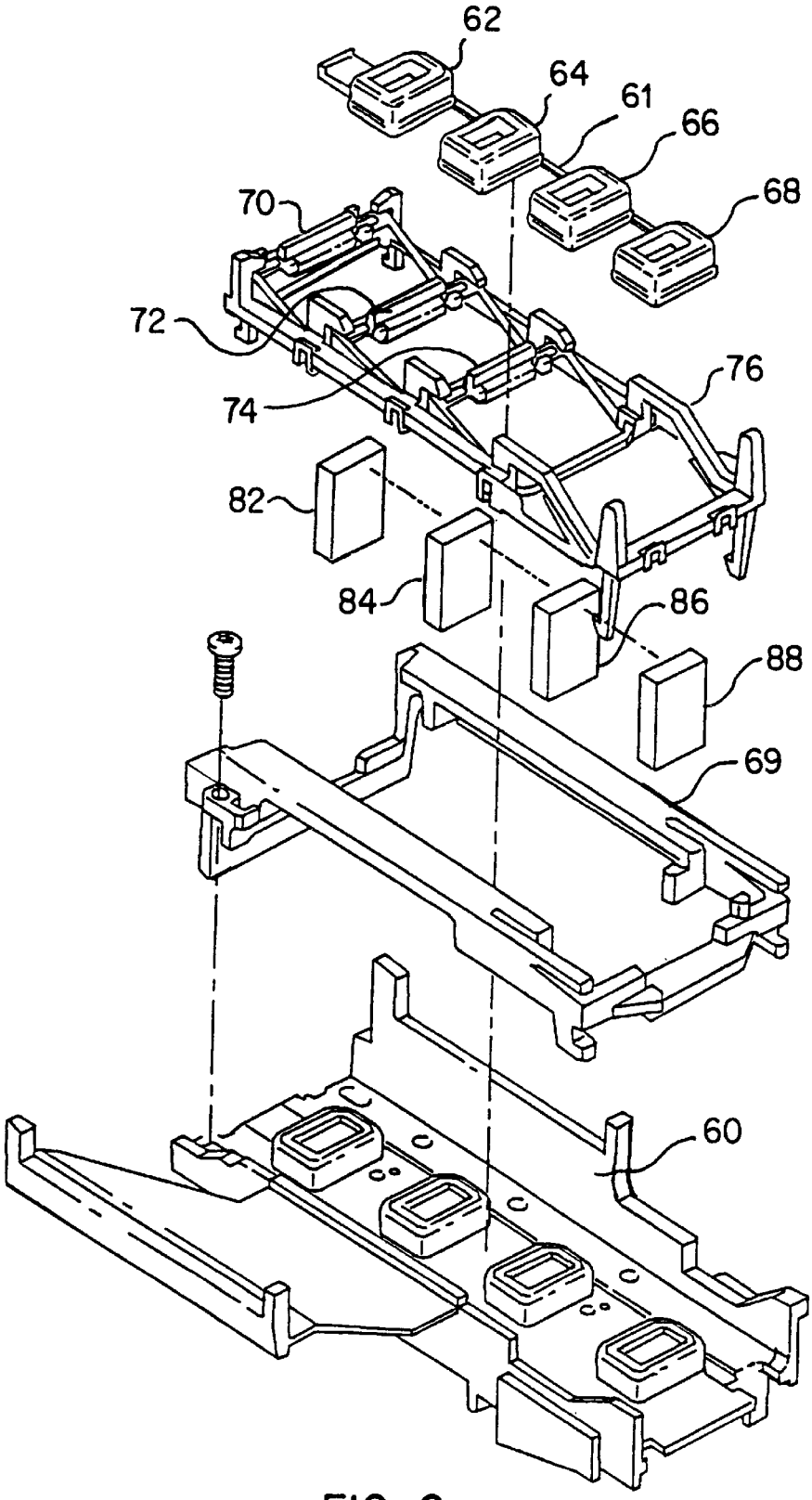
FIG. 6 is an exploded view of the functional service station components of the second service station, previously shown in dotted lines in FIG. 5.

Referring now to FIGS. 3, 5 and 6, the second service station 52 includes sled 60 having a bar 61 for holding caps 62, 64, 66, 68. When the carriage 20 is not being used for printing and is not in position at the first service station, the carriage moves all the way to the right to enable the caps to engage their respective printhead nozzle surfaces, thereby preventing the ink orifices in the printhead from drying out.

A wiper support structure 69 rests on the sled 60. Three wiper blades 70, 72, 74 are each mounted with spring loading on a frame 76 for the CYM printheads, respectively, to remove contaminants or crusted ink that may block the printhead nozzles. Each wiper is dedicated exclusively to only one of the color ink printheads, while wiper blade member 688 in the first service station is dedicated exclusively to only the black ink printhead.

The second service station also provides for selective priming each individual CYMK printhead by moving a selection lever 78 to align with an appropriate cartridge, and then manually depressing plunger 80. Air is drawn through one of filters 82, 84, 86, 88 of through one of the central apertures 90, 92, 94, 96 in each capper. Thus, if for some reason ink is no longer in the firing chamber for a particular printhead, a vacuum source (not shown) draws air through a central aperture and through the nozzle connected to a particular firing chamber, while the carriage is in the capping position in the second service station, to draw ink from an ink reservoir of the print cartridge into the firing chamber.

The "spitting" function for all four printheads is handled by the first service station. This is particularly important when cartridges have been capped for a lengthy period of time. Before resuming printing, a series of ink drops are fired in a spitting operation to clear crusted ink from the nozzles. Such spitting can be scheduled to correlate with a wiping operation for the black ink cartridge in the first station, as well as with a wiping operation for the color ink cartridges in the second station.

Figure 7:
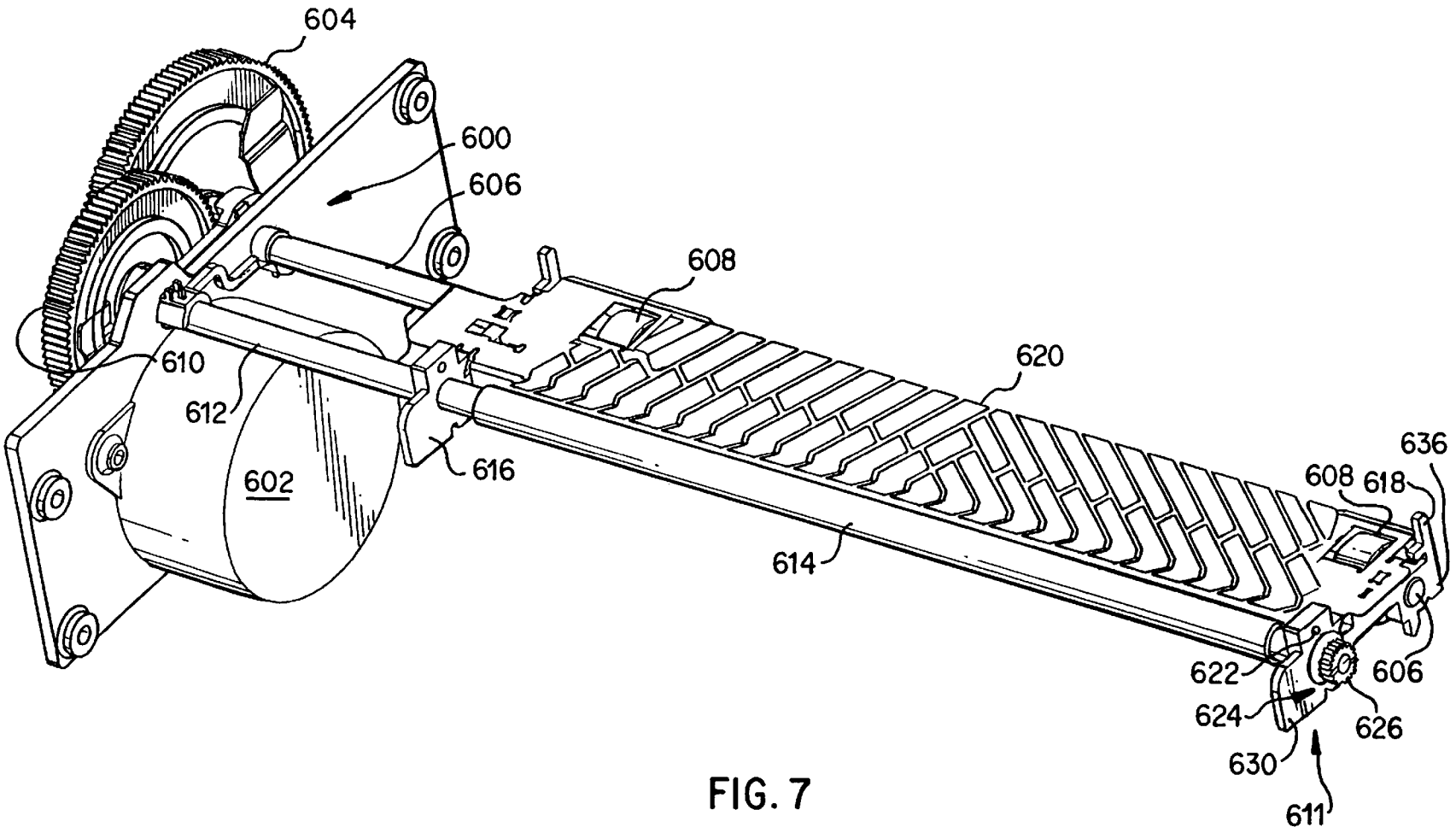
FIG. 7 is a perspective view showing a media advance drive roller system for a print zone, with a first service station drive gear mounted on one end of a media advance drive axle.
Figure 8:
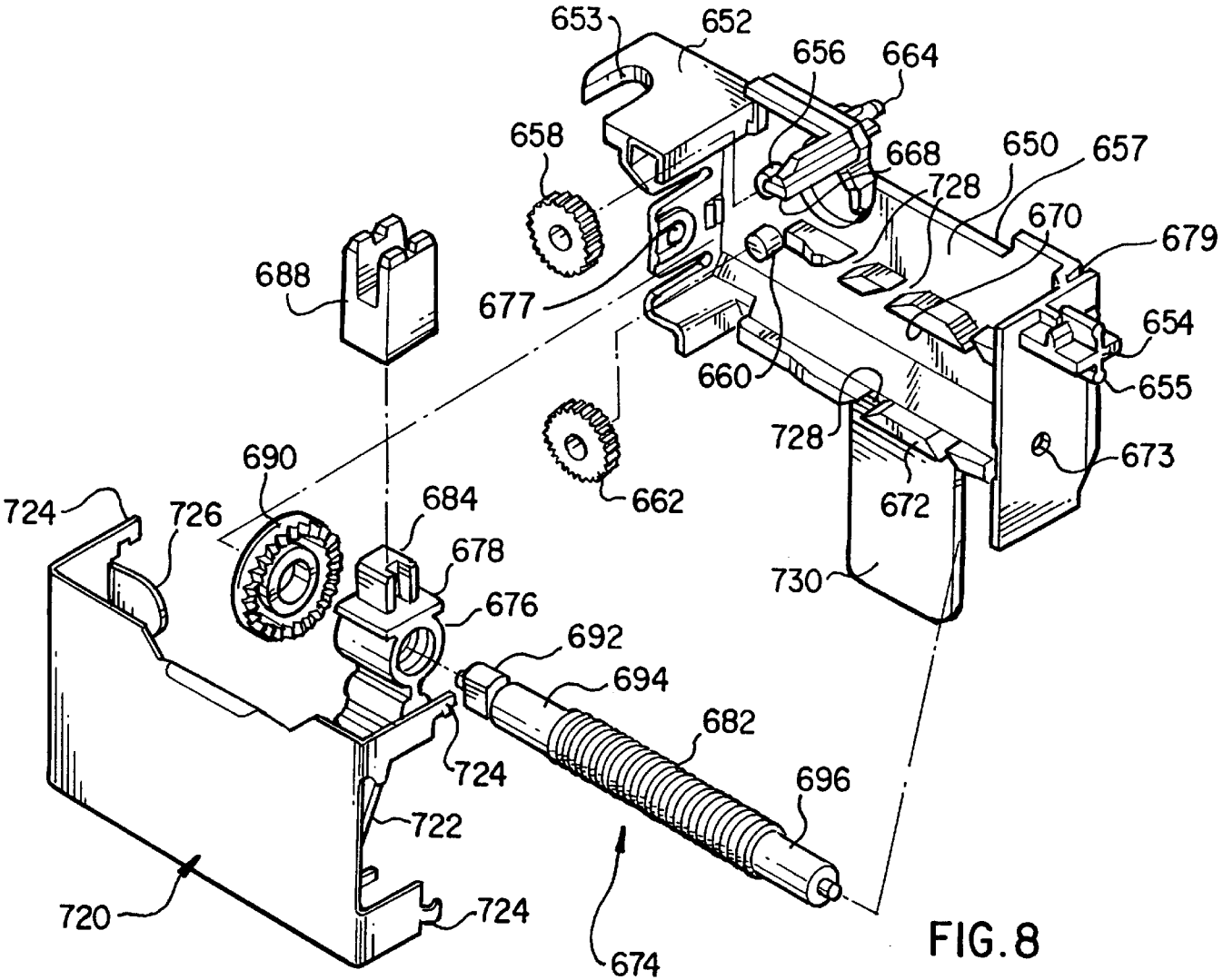
FIG. 8 is an exploded view of a first service station.
Figure 9:
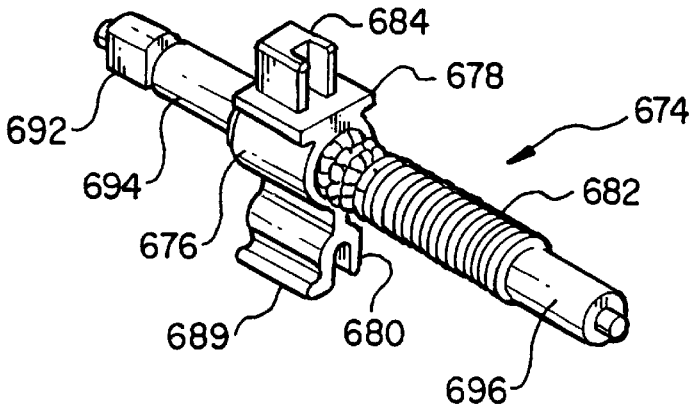
FIG. 9 shows a wiper base on a lead screw of the first service station.
Figure 10:
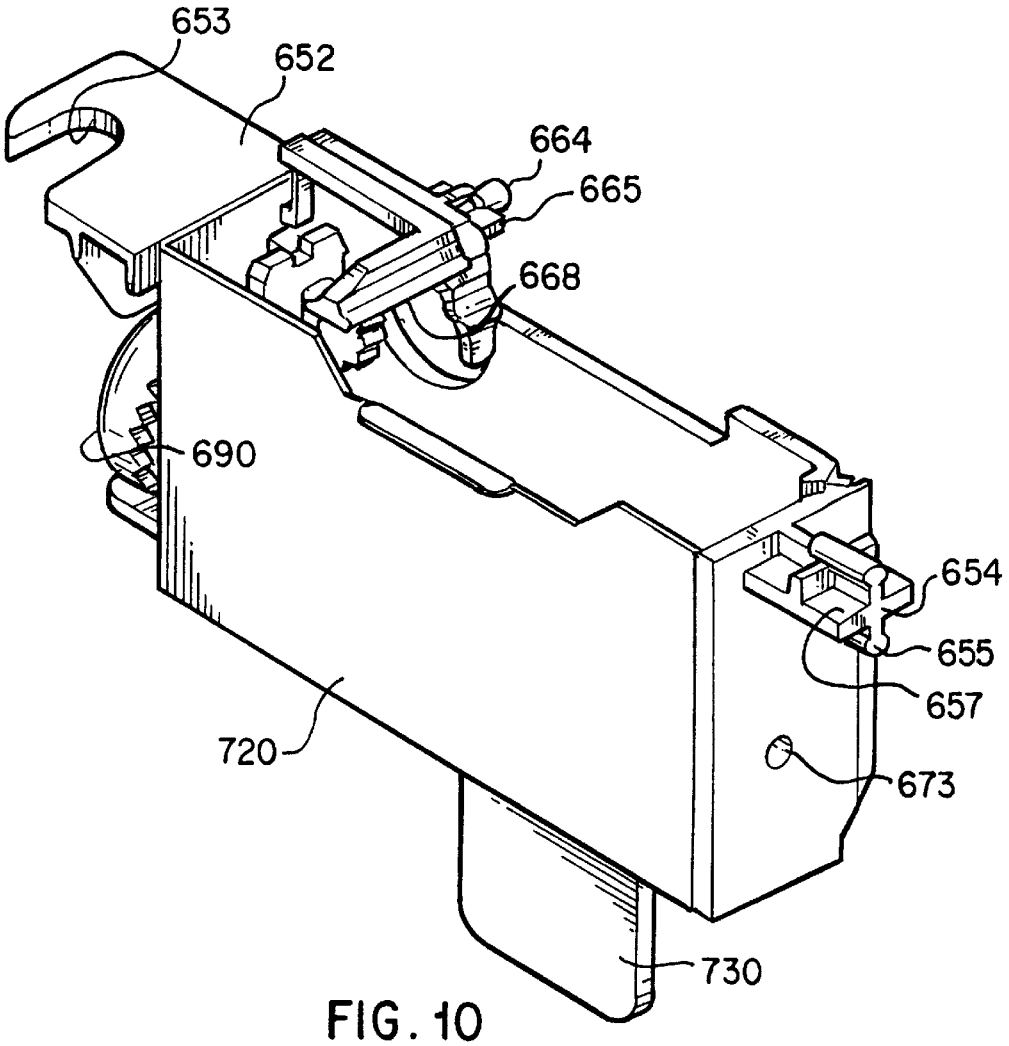
FIG. 10 is a perspective view of a first service station ready for installation on the printer, with a wiper unit in parked position.
Figure 11:
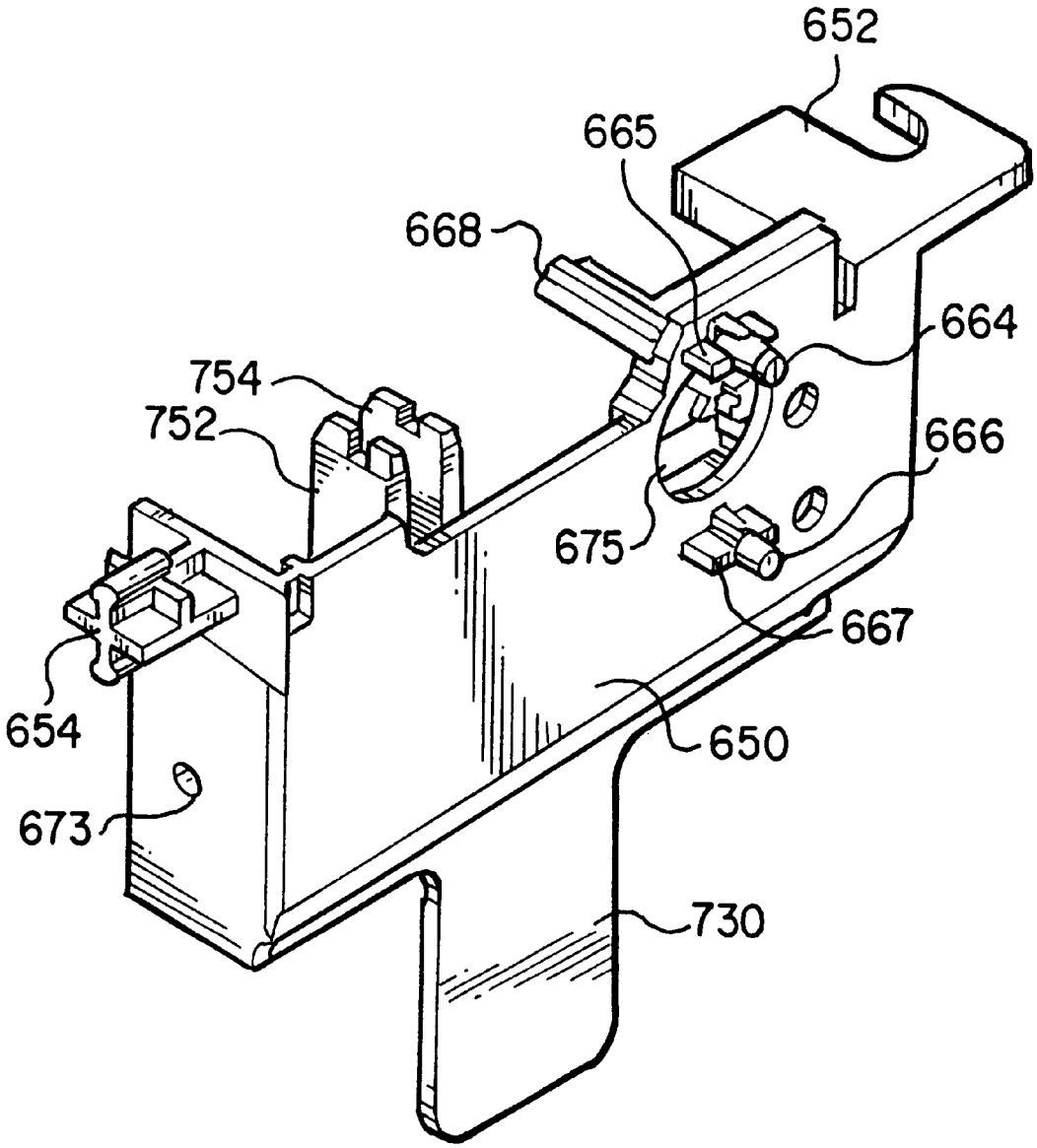
FIG. 11 is a perspective view of a housing portion of the first service station.

The perspective view of FIG. 7 shows how a first service station 50 can be actuated by a media advance motor, and also identifies one frame of reference for use in positioning a wiper unit in the first service station relative to the printhead and to the printer platen. In that regard, the media advance system for an inkjet printer with a heated print zone such as the Hewlett-Packard DeskJet 1200 C inkjet printer includes a vertical support plate 600, a stepper motor 602, a main drive gear 604 which drives a first axle 606 carrying primary drivewheels 608, a secondary drive gear 610 which drives a second axle 612 carrying secondary driveroller 614. Left and right bushing plates 616, 618 provide precise positioning of the drivewheels 608 and the driveroller 614 closely adjacent to a screen platen 620 which supports media passing through a heated print zone.

In the present invention, the right bushing plate 618 is modified to provide precise positioning of a unique first service station unit which is located next to the right bushing plate. The right bushing plate includes a top hole 622 and a bottom hole 624 for positional mounting of the first service station unit. A service station drive gear 626 is fixedly mounted on the right end of second axle 612. A front datum projection 630 fits into matching slot 632 on a service station chassis 634, while a rear datum projection 636 fits into another matching slot 638. Thus the service station chassis provides another frame of reference for positioning a wiper unit in the first service station relative to the printhead and to the printer platen.

The structural details of the first service station unit are best shown in FIGS. 8–11. A housing 650 includes a front mounting tab 652 with screw slot 653, back mounting tab 654 with walls 655, 657, top bearing pin 656 for rotatably mounting top spur gear 658, bottom bearing pin 660 for rotatably mounting bottom spur gear 662, externally projecting mounting members (for holes 622, 624, respectively) such as a secondary top mounting pin 664 with spacer 665 and primary bottom mounting pin 666 with spacer 667, scraper 668, upper and lower cam surfaces 670, 672, and forward and rear bearing holes 673 for rotatably mounting a lead screw 674. A large opening 675 in the housing 650 allows drive gear 626 to extend through a housing wall for engagement with spur gear 658, thereby providing a gear train through bottom spur gear 662 to face gear 690. Chassis hole 677 is positioned for attaching alignment with screw slot 653, and chassis slot 679 is positioned for engagement with walls 655, 657.

A nut member is provided to form a wiper base 676 which has upper and lower cam followers 678, 680 which respectively track upper and lower cam surfaces 670, 672 as the wiper base moves in a back-and-forth linear motion along a central threaded portion 682 of the lead screw 674. An upwardly projecting key shaft 684 on the wiper base 676 is shaped to engage a matching interior mounting channel 686 of a removable wiper blade 688. An extending toe on the wiper base provides asymmetry to avoid assembling the wiper base facing in the wrong direction on the leadscrew.

A face gear 690 is mounted on a square hub 692 of the lead screw 674 as the last element in a gear train to rotatably drive the lead screw. The lead screw 674 includes unthreaded front and back portions 694, 696 to provide temporary parking positions for the wiper base after it has traversed along the central threaded portion 682 during rotation of the lead screw by the face gear.

A cover 720 is sized and shaped to fit together with the housing 650 to form a spittoon in the first service station. The cover includes a front spring arm (not shown) and a back spring arm 722 to urge the wiper base into engagement with the central threaded portion 682 during appropriate time periods of the wiping procedure. Arm hooks 724 are provided for engagement with matching slots on the housing, and tab plates 726 serve to hold the spur gears 658, 662 in position on the housing. To facilitate movement of the wiper member 688 back and forth along the lead screw, slots 728 in both upper and lower cam surfaces 670, 672 allow ink to descend down into a bottom spittoon area (not shown) where an enlarged diaper pad absorbs excess ink. Also, an elongated wicking member 730 extends downwardly from the housing to help draw residual liquid ink down and away from important moving printer parts and away from the print zone. The back-and-forth movement of the wiper member 688 also helps to-avoid crippling buildup of ink in the spittoon.

Figure 12B:
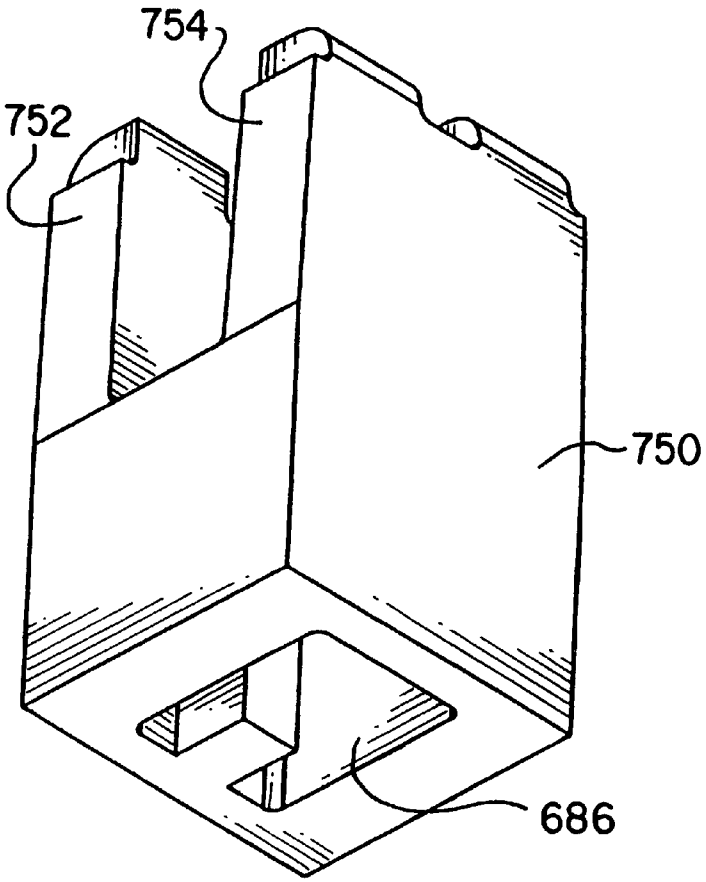
FIGS. 12A and 12B are enlarged perspective top and bottom views, respectively, of a wiper blade component of the first service station.
Figure 12A:
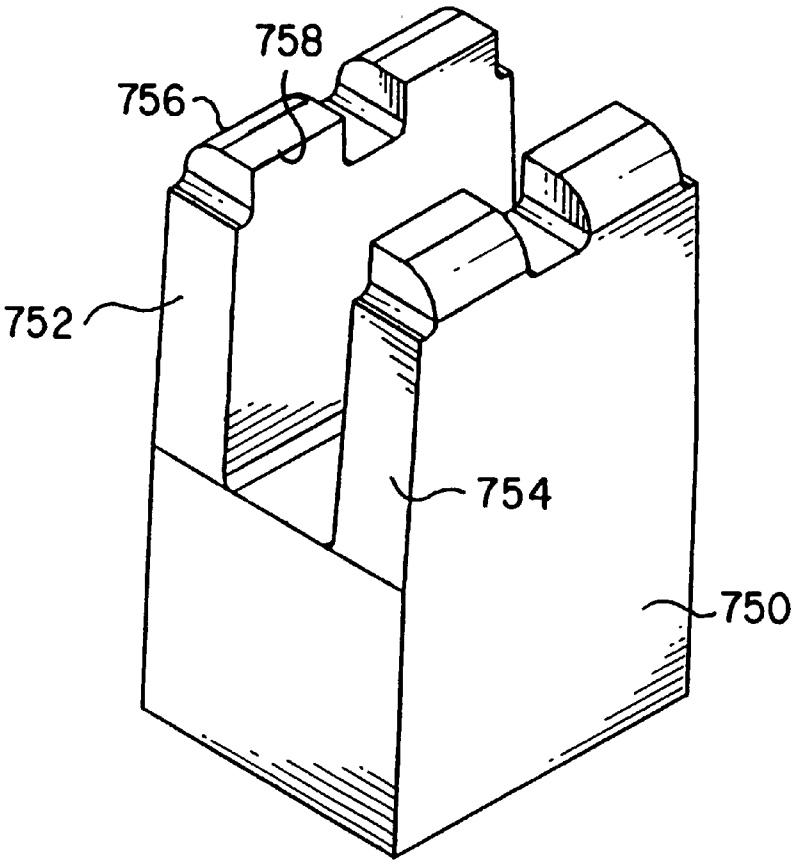
Figure 13:
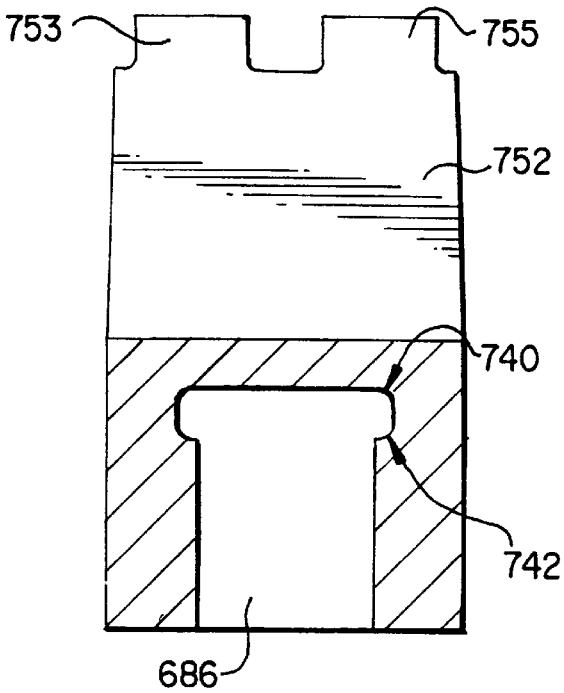
FIG. 13 is a partially sectional view showing an interior mounting channel of the wiper blade component of FIGS. 12A and 12B.
Figure 14:
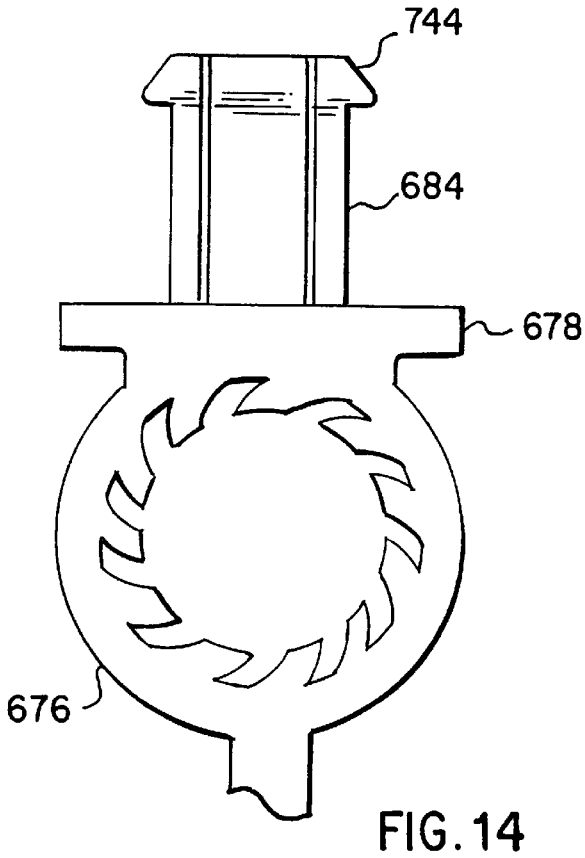
FIG. 14 is a partial side view of a wiper base showing a key shaft for engagement with the interior mounting channel of FIG. 13.

As shown in FIGS. 12A–12B and 13, secure but removable attachment of a wiper blade member 750 made with an elastomer material such as EPDM rubber is provided by an end wall 740 and a lateral headwall 742 for receiving and engaging splayed head 744 on wiper base 684. Wiper blade member 750 includes successive wiper blades 752, 754 which are split to form separate spaced apart wiping sections 753, 755. Each section presents a rounded edge 756 and a sharp edge 758 to sequentially wick ink from orifices onto a nozzle surface of the printhead with the rounded wiper edge and immediately thereafter remove ink from the nozzle surface of the printhead with the sharp wiper edge. By positioning the successive wiper blades in a mirror image orientation, the rounded wiper edge necessarily engages the nozzle surface first and the sharp edge engages the nozzle surface immediately thereafter. Thus, wet ink resolubalizes any dried ink on the nozzle surface, and the sharp edge immediately cleans the surface before any dried ink buildup occurs. The aforementioned split configuration is particularly designed for use with inkjet nozzle arrays having two columns of ink orifices, such as a ⅓ inch swath printhead 802 with approximately one hundred nozzles (#1–#100) in a 300 dpi array and/or a ½ inch swath printhead 804 with approximately three hundred nozzles (#1–#300) in a 600 dpi array (see FIG. 15).

In accordance with all of the foregoing, the first service station provides for the unique wiping/scraping procedure as set forth in the flow chart of FIGS. 16A–16B. It will be understood from the self-explanatory flow chart that initially the wiper blades are parked in an idle position with the wiper base in a home position on the unthreaded portion of the lead screw, even though the lead screw continues to rotate during a printing operation. After the printing operation is completed and the media is advanced out of the print zone, a scheduled wiping operation is commenced by reversing the stepper motor to activate the first service station. As the threads of the lead screw engage the wiper nut, the flexible wiper blade edges are first driven across the rigid scraper to clean them in order to avoid damaging the nozzle surface, and then are driven across the ink orifices for the wicking/cleaning actions previously described. The cycle is completed by reversing the stepper motor to again accomplish the wicking/cleaning actions followed by the step of scraping the flexible wiper blade edges. The threaded wiper base then moves into an idle or parked position due to the clutch action of the unthreaded portion of the lead screw. It is to be noted that while the accumulation of ink on a nozzle surface of the printhead is normally an undesirable thing, in this instance the wicking of ink from a nozzle array by the rounded edge of the leading wiper blade is very important here to achieve successful cleaning of the nozzle surface by lubricating the nozzle surface and by resolubalizing any residual dried ink on the nozzle surface.

The different wiping speeds and the time required to perform each full wiping cycle in the preferred embodiment of the invention are shown in the timing diagram of FIG. 17. Thus, translational wiping is accomplished in both directions at different speeds as determined by print quality reliability standards.

It will be appreciated by those skilled in the art that the various datum mechanical interconnects precisely position the wiping mechanism of the first service station. If the media advance axis is called the X-axis, then primary positioning in the X direction is provided by lower pin 666. A first rotational positioning is provided by wall 657 and tab 652. A second rotational positioning is provided primarily by spacers 665, 667. Additional rotational positioning about the Z-axis is provided by lower wall 655 and spacers 665, 667.

By providing specialized wiping services to a high resolution wide swath pigment based black ink pen, this invention allows higher resolution and speed to occur for frequently printed features such as text and the most frequent color components of graphics—viz, black. Thus by printing these frequent features and components faster and at a higher resolution, the entire page is faster and of higher quality and is more comparable with laser printing performance (8+pages per minute) and laser printing quality (600 dpi resolution).

It should be understood that the foregoing description is only illustrative of the invention. Various alternatives and modifications may be made by those skilled in the art without departing from the spirit of the invention. Accordingly, the present invention is intended to include all such alternatives, modifications and variations which fall within the scope of the following claims.

We claim as our invention:

1. An inkjet printing system having multiple printheads in a carriage member which move along a printhead path through a print zone, comprising:

a first printhead mounted in said carriage member, said first printhead having a first nozzle configuration;

a second printhead mounted in said carriage member, said second printhead having a second nozzle configuration which is different from said first nozzle configuration;

a first service station located in said printhead path for performing a first wiping procedure on said first printhead wherein a first wiper blade comprising the first service station is moved to wipe across a stationary nozzle surface of said first printhead; and a second service station located in said printhead path for performing a second wiping procedure on said second printhead, wherein said first wiping procedure is different from said second wiping procedure, said second service station comprising a second wiper blade held in a stationary position as the second printhead is moved across said second wiper blade during said second wiping procedure.

2. The inkjet printing system of claim 1 wherein said first service station includes a first wiper blade which is used in said first wiping procedure, and said second service station includes a second wiser blade used in said second wiping procedure, wherein said first wiper blade is different from said second wiper blade.

3. The inkjet printing system of claim 1 wherein said first wiping procedure uses a wet wiping procedure for removing residual ink on a nozzle surface of said first printhead.

4. The inkjet printing system of claim 1 wherein said first wiping procedure uses a fixed scraper to remove ink from said moving first wiper blade.

5. The inkjet printing system of claim 1 wherein said first service station includes a spittoon for a spitting operation with said first printhead.

6. The inkjet printing system of claim 5 wherein said first service station includes a spittoon for a spitting operation with said second printhead.

7. The inkjet printing system of claim 1 wherein said second printhead includes a plurality of color ink printheads.

8. An inkjet printer having a carriage for holding a first printhead and a second printhead, the carriage moving along a printhead path in a carriage scan direction across a print zone, comprising:

a service station located on the printhead path and displaced from the print zone;

a wiper blade mounted in an upright position in said first service station;

an actuation means for moving said wiper blade along a wiping path in a wiping direction orthogonal to the carriage scan direction during a wiping operation for wiping the first printhead;

a spittoon located in said service station in a vicinity of an intersection between the printhead path and the wiping path for receiving drops of ink generated by the first printhead during a first spitting operation for the first printhead and for receiving drops of ink generated by the second printhead during a second spitting operation; and wherein said actuation means is for moving said wiper blade through said spittoon during said wiping operation, and to move said wiper blade to a rest position away from the printhead path during the second spitting operation.

9. The inkjet printer of claim 8 which further includes a wicking member in said spittoon and extending downwardly away from the printhead to draw ink away from the printhead and the print zone.

10. The inkjet printer of claim 8 which further includes a stationary scraper in said spittoon for scraping residual ink from said wiper blade as said wiper blade moves along the wiping path.

11. The inkjet printer of claim 8 wherein said actuation means moves said wiper blade back and forth across ink orifices on a nozzle surface of the printhead.

12. The inkjet printer of claim 8, which further includes a second service station having different wiper blades for performing a wiping operation on said second printhead.

13. A method of servicing multiple printheads in an inkjet print carriage without removing them from the carriage, which moves along a printhead path through a print zone while simultaneously holding the multiple printheads, the method comprising the steps of:

performing a first wiping operation using a first wiper blade on a first printhead in a first service station located in said printhead path, said first wiping operation comprising holding the first printhead in a stationary position and moving the first wiper blade across the first printhead;

performing a second wiping operation using a second wiper blade on a second printhead in a second service station located in said printhead path, wherein said second wiper blade used in said second wiping operation is different from said first wiper blade used in said first wiping operation, said second wiping operation comprising holding the second wiper blade in a stationary wiping position and moving the carriage so that the second printhead is moved across the second wiper blade.

14. The method of claim 13 which further includes performing a spitting operation on the first and second printheads in said first service station.

15. The method of claim 13 which further includes performing a priming operation on said first and second printheads in said second service station.

16. The method of claim 13 which further includes performing a capping operation on said first and second printheads in said second service station.

17. The method of claim 13 which further includes:

performing a capping operation and a priming operation on said first and second printheads in said second service station.

18. A printhead service system, comprising:

a low resolution printhead service station for servicing a plurality of low-resolution printheads;

a high resolution printhead service station mounted in a side by side common horizontal plane relationship with said low resolution printhead service station for servicing a single high-resolution printhead; and a split blade wiper for engaging said high-resolution printhead only to perform in seriatim;

a wicking service to solubilize dried ink contaminants disposed on said high resolution printhead; and a wiping service to remove the solubilized dried ink contaminants disposed on said high-resolution printhead.

19. A printhead service system according to claim 18, wherein the high resolution printhead includes an orifice plate having a plurality of inkjet nozzles arranged in a spaced apart pair of nozzle columns.

20. A printhead service system, comprising:

a color ink printhead service station for removing residual nozzle contaminants from a plurality of low-resolution printheads;

said color ink service station and said plurality of low resolution printheads being aligned about a common horizontal carriage axis to facilitate printhead cleaning when said plurality of low resolution printheads are positioned in a non printing position; and a black ink printhead service station for removing residual nozzle contaminants from a single high-resolution printhead;

said black ink service station and said single high resolution printhead being aligned about said common horizontal carriage axis to further facilitate printhead cleaning when said single high resolution printhead is positioned in another non printing position;

wherein said high-resolution printhead includes an orifice plate having a plurality of inkjet nozzles arranged in a spaced apart pair of nozzle columns;

wherein said black ink printhead service station includes:

a split blade wiper for engaging simultaneously each column of nozzles in said single high resolution printhead to perform in seriatim with said wiper a wicking service to resolublized dried ink contaminants disposed on said orifice plate and a wiping service to remove the resolublized dried ink contaminants from the orifice plate of said high resolution printhead; and wherein said split blade wiper includes:

at least two pair of mirror image edge members each having a rounded edge portion for facilitating said wicking service and a sharp edge portion for facilitating said wiping service.

21. A printhead service system according to claim 20, wherein said at least two pair of mirror image edge members facilitate orifice plate wicking and wiping in diametrically opposing directions.

22. A printhead service system, comprising:

a color ink printhead service station for removing residual nozzle contaminants from a plurality of low-resolution printheads;

said color ink service station and said plurality of low resolution printheads being aligned about a common horizontal carriage axis to facilitate printhead cleaning when said plurality of low resolution printheads are positioned in a non printing position; and a black ink printhead service station for removing residual nozzle contaminants from a single high-resolution printhead;

said black ink service station and said single high resolution printhead being aligned about said common horizontal carriage axis to further facilitate printhead cleaning when said single high resolution printhead is positioned in another non printing position;

wherein said high-resolution printhead includes an orifice plate having a plurality of inkjet nozzles arranged in a spaced apart pair of nozzle columns;

wherein said black ink printhead service station includes:

a split blade wiper for engaging simultaneously each column of nozzles in said single high resolution printhead to perform in seriatim with said wiper a wicking service to resolublized dried ink contaminants disposed on said orifice plate and a wiping service to remove the resolublized dried ink contaminants from the orifice plate of said high resolution printhead; and wherein said black ink printhead service station further includes a scraper for engaging said split blade wiper to remove contaminants therefrom prior to said wiper engaging said plurality of ink nozzles.

23. A printhead service system, comprising:

a color ink printhead service station for removing residual nozzle contaminants from a plurality of low-resolution printheads;

said color ink service station and said plurality of low resolution printheads being aligned about a common horizontal carriage axis to facilitate printhead cleaning when said plurality of low resolution printheads are positioned in a non printing position; and a black ink printhead service station for removing residual nozzle contaminants from a single high-resolution printhead;

said black ink service station and said single high resolution printhead being aligned about said common horizontal carriage axis to further facilitate printhead cleaning when said single high resolution printhead is positioned in another non printing position; and wherein said plurality of low resolution printheads further being aligned about said common horizontal carriage axis for facilitating their ejecting of different color ink droplets onto a print medium surface in a common color ink swath having a given height when said low resolution printheads are not stationed in said color ink service station;

wherein said single high resolution printhead further being aligned about said common horizontal axis for facilitating the ejecting of black ink droplets onto the print medium surface in a black ink swath having another given height when said high resolution printhead is not stationed in said black ink service station; and said another given height of said black ink swath being substantially greater in height than said given height of the color ink swath so that in a high performance mode of operation, the black ink droplets ejected in the common color ink swath can be mixed with the color ink droplets ejected in the common color ink swath to improve color graphics throughput.

24. A printhead service system according to claim 18 further comprising:

a plurality of wipers for engaging corresponding ones of said plurality of low resolution printheads only to facilitate printhead cleaning of the individual ones of said plurality of low resolution printheads.

* * * * *

UNITED STATES PATENT AND TRADEMARK OFFICE

CERTIFICATE OF CORRECTION

PATENT NO. : 5,984,450

DATED : November 16, 1999

INVENTOR(S) : Becker, et al

It is certified that error appears in the above-identified patent and that said Letters Patent is hereby corrected as shown below:

Column 7, line 56, after "a second" delete "wiser" and insert in lieu thereof --wiper--.

Signed and Sealed this

Twenty-eighth Day of November, 2000

*Attest:*

*Attesting Officer*

Q. TODD DICKINSON

*Director of Patents and Trademarks*